US006286925B1

(12) United States Patent
Heinzl et al.

(10) Patent No.: US 6,286,925 B1
(45) Date of Patent: Sep. 11, 2001

(54) METHOD OF CONTROLLING PIEZO ELEMENTS IN A PRINTHEAD OF A DROPLET GENERATOR

(75) Inventors: Joachim Heinzl, München; Alfred Zollner, Eitting; Peter Möstl, Altdorf, all of (DE); Gerhard Beurer, Stockholm (SE); Joachim Kretschmer, Rüti (CH)

(73) Assignee: Pelikan Produktions AG, Egg (CH)

( * ) Notice: Subject to any disclaimer, the term of this patent is extended or adjusted under 35 U.S.C. 154(b) by 0 days.

(21) Appl. No.: 08/946,643

(22) Filed: Oct. 7, 1997

(30) Foreign Application Priority Data

Oct. 8, 1996 (CH) ..... 2446-96

(51) Int. Cl.[7] ..... B41J 29/38
(52) U.S. Cl. ..... 347/12; 347/68; 347/54
(58) Field of Search ..... 347/10–12, 68–71, 347/94

(56) References Cited

U.S. PATENT DOCUMENTS 5,142,296 * 8/1992 Lopez et al. ..... 347/12
5,221,931 6/1993 Moriyama .
5,438,350 * 8/1995 Kerry et al. ..... 347/12
5,461,403 * 10/1995 Wallace et al. ..... 347/10
5,764,247 * 6/1998 Asai ..... 347/10

FOREIGN PATENT DOCUMENTS 0376532 7/1990 (EP) .
0 713 773 A2 10/1995 (EP) .
WO 95/25011 9/1995 (WO) .

OTHER PUBLICATIONS

Patent Abstracts of Japan, vol. 16, No. 480 (M–1321), Oct. 6, 1992; and JP 04175167A, Jun. 23, 1992.
Patent Abstracts of Japan, vol. 18, No. 173 (M–1581), Mar. 24, 1994; and JP 05338165, Dec. 21, 1993.

* cited by examiner

*Primary Examiner*—John Barlow
*Assistant Examiner*—Michael S Brooke
(74) *Attorney, Agent, or Firm*—Fay, Sharpe, Fagan, Minnich & McKee, LLP

(57) ABSTRACT

The printhead has a multitude of adjacently arranged channels with piezo-electrical shear converters. The impulse form for activation of the converters—depending upon the number of simultaneously activated neighboring channels—is changed in such manner that the exit velocity of the ink droplets is constant. This makes it possible to obtain a better print image.

19 Claims, 9 Drawing Sheets

METHOD OF CONTROLLING PIEZO ELEMENTS IN A PRINTHEAD OF A DROPLET GENERATOR

BACKGROUND OF THE INVENTION

The invention pertains to the art of printheads and, more particularly, to a method of controlling piezo elements in a printhead of a droplet generator.

An example of a method for operation of a printhead of an ink jet printer is disclosed in WO 95/25011. That printhead has a multitude of adjacently arranged channels, each of which is allocated to a nozzle. By activation of a channel, a droplet of ink is expelled from the respective nozzle. Through impulse control, the result is obtained that pressure waves within an activated channel will fade more rapidly. With this solution, the amplitude values of the impulses are adjusted, for which purpose linear amplifiers are needed. Such devices, though, have a poor efficiency and require expensive electronic components. The pulse widths are limited to whole number multiples of an acoustic period L/c, wherein L represents the length of the channel and c the sound velocity in the liquid. It is only possible, due to the complexity of the impulses, to operate all channels with the same impulse voltage and with the same pulse width.

Another example of an operating process for a piezo-electrical printhead is shown in U.S. Pat. No. 5,461,403. The width of the control impulses is varied in order to modulate the droplet velocity and the droplet volume. This is intended to create various stages of gray. A variation of the impulse width results in a change of the droplet size. The large number of impulse parameters requires expensive tabulation. Because of the complexity of the table, it is only possible to operate all channels with the same impulse voltage and the same impulse width.

In both of the previously known solutions, the print image may be affected if the printhead is moved at constant relative velocity vis-a-vis the paper to be imprinted.

SUMMARY OF THE INVENTION

It is an object of the present invention to provide a process for the operation of a printhead which avoids the above drawback. The objective is solved by a combination of characteristics.

According to one aspect of the present invention, a method of controlling piezo-elements in a printhead of a droplet generator with a multitude of adjacently arranged ink channels is provided. The piezo-elements are controlled so that the exit velocity of the droplets is independent of the number of simultaneously activated neighboring channels Still other advantages and benefits of the invention will become apparent to those skilled in the art upon a reading and understanding of the following detailed description.

BRIEF DESCRIPTION OF THE DRAWINGS

The following is an exemplary embodiment of the invention, which will be described in detail in this specification and illustrated in the accompanying drawings which form part thereof, wherein.

DETAILED DESCRIPTION OF THE PREFERRED EMBODIMENT

Figure 1:
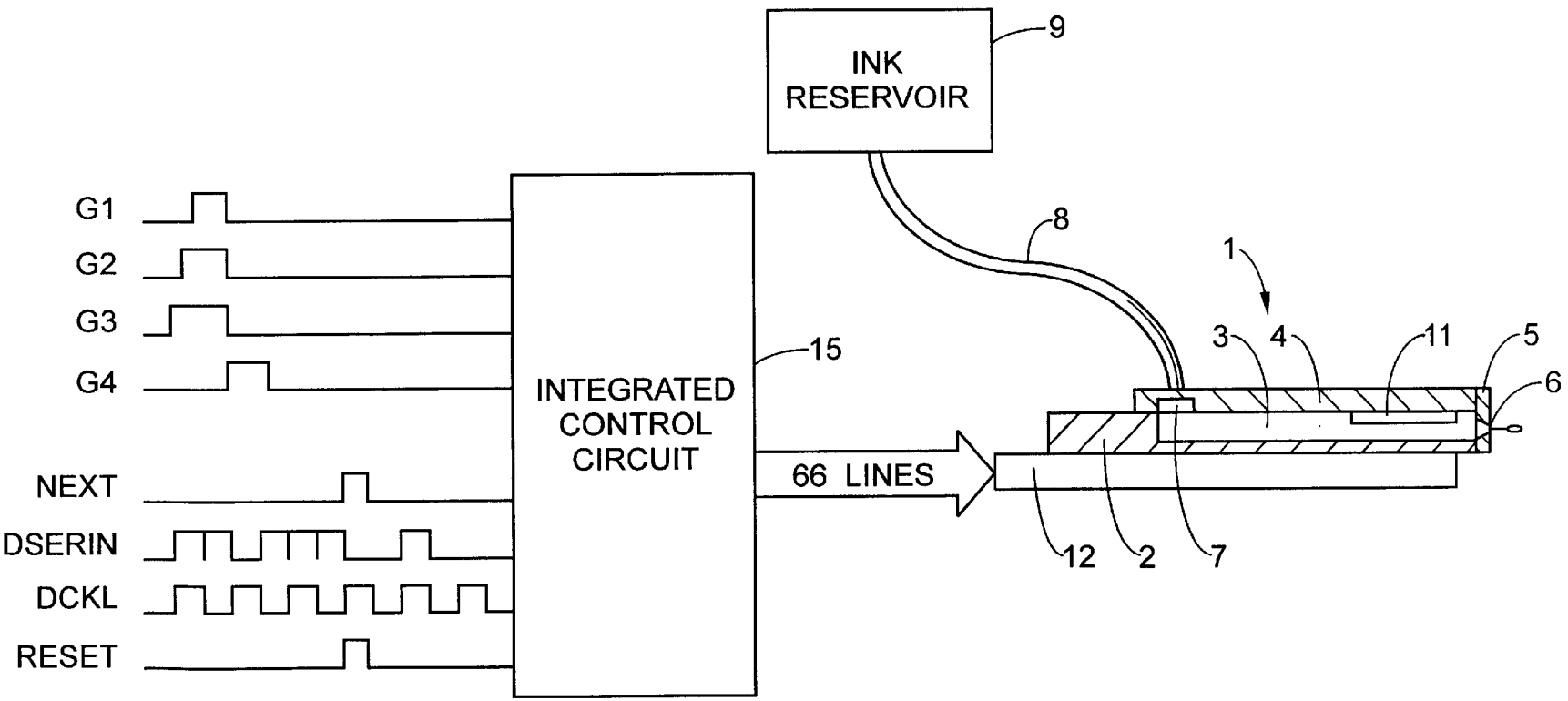
FIG. 1 shows a schematic longitudinal section through a printhead with a block diagram of the selective control.
Figure 2:
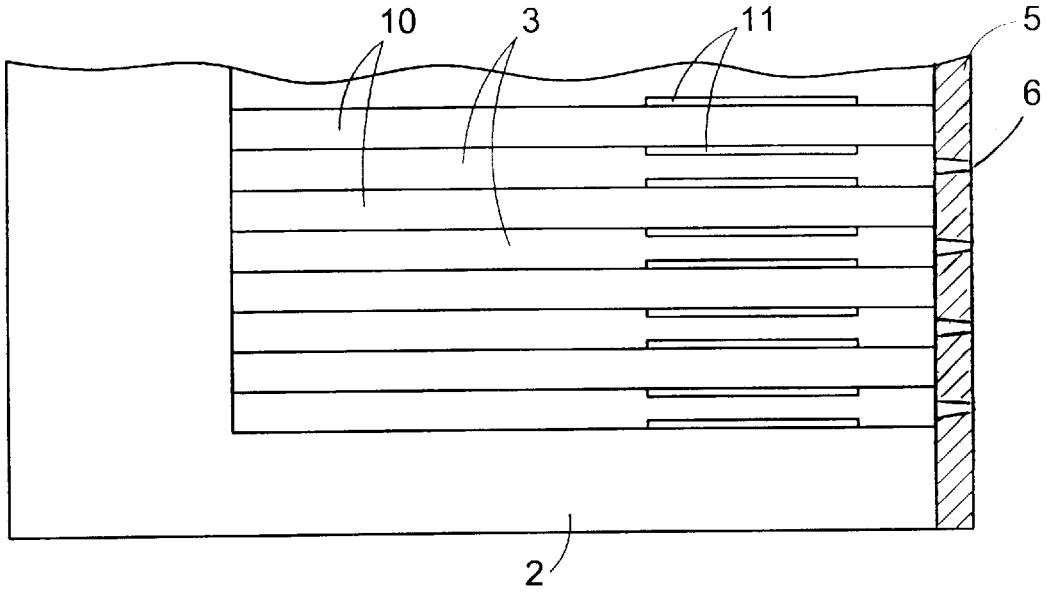
FIG. 2 shows a horizontal section through the printhead of FIG. 1.
Figure 3:
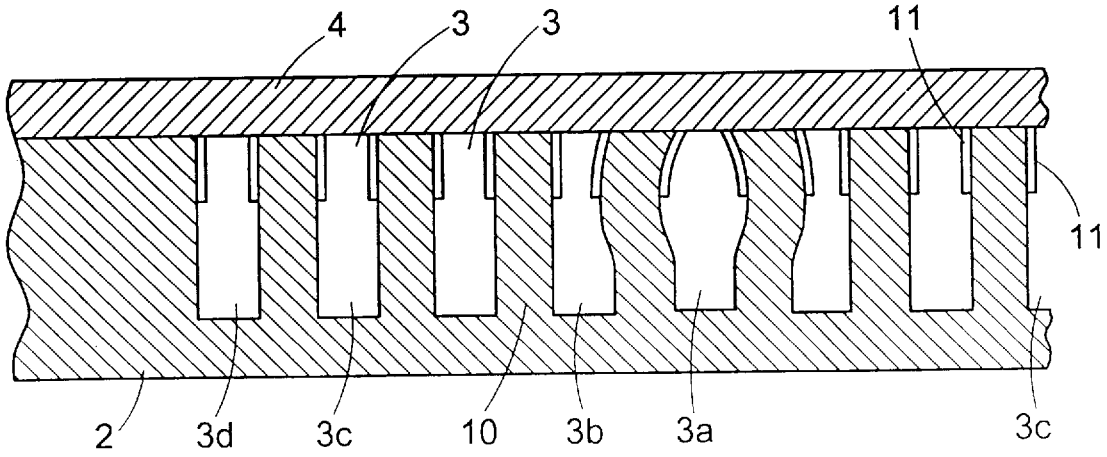
FIG. 3 shows a cross section of the printhead of FIG. 1.

Referring now to the drawings wherein the showings are for the purposes of illustrating the preferred embodiment of the invention only and not for purposes of the limiting same, part of a piezo-electrical printhead 1 of an ink jet printer, according to the shear converter principle, is shown in FIGS. 1 to 3, schematically greatly magnified and not true to scale. It consists of a piezo-ceramic disk 2, in which are recessed, next to each other, a multitude of longitudinally extending, identical, rectangular in cross-section channels 3, a cover disk 4 and a jet disk 5, which has, at the front end of each channel 3, a jet 6. On the opposing front end, all channels 3 are connected with each other via a transverse channel 7 in the cover plate 4. A connection line 8 to the ink storage container 9 issues, or discharges, into channel 7. Each separation wall 10 between the channels 3 is fitted on both sides over part of the surface with an electrode 11, i.e., furnished with an electrically conducting coat. Said disk 2 is mounted onto a base plate 12. If the electrode pair of a wall 10 is put under electrical tension, then there is produced, due to the polarization direction of the piezo material, a shearing action with respect to channel separation wall 10. As a result of the mounting, wall 10 becomes deformed as sketched in FIG. 3. If two neighboring walls 10 become deformed in opposite directions, then there takes place a volume increase or decrease of the activated channel 3*a*. The impulse form, placed on the electrodes 11, is sub-divided into a suction impulse and a counter-directional expulsion impulse. With the suction impulse, the walls of the activated channel 3*a* become deformed as shown in FIG. 3, so that ink from channel 7 is sucked into the activated channel 3*a*. With the expulsion impulse, the activated walls 10 become deformed in the opposite direction, so that a droplet is expelled from jet 6 of the activated channel.

As is apparent from FIG. 3, with the represented shear conversion type, during activation of the one channel 3*a*, the other immediately adjacent channels 3*b* are likewise influenced. The impulse form is chosen in such fashion that the thereby created pressure vibration in these neighboring channels 3*b* is insufficient in order to expel a droplet from their jet. With the described conversion type, however, there should not likewise take place, simultaneously with the activated walls 10 of channel 3*a*, an activation of one of the immediately adjacent walls 10, because otherwise the pressure vibrations in channel 3*b* would become too powerful. With this conversion type, it is therefore appropriate to operate the channels 3 and thus the jets 6 in such manner that in each case no more than each third channel is simultaneously activated. The channels and their selective control are thus divided into groups of three, which are operated successively. It is, however, also possible to divide the channels into groups of four, five or six, which are operated in succession.

Figure 4:
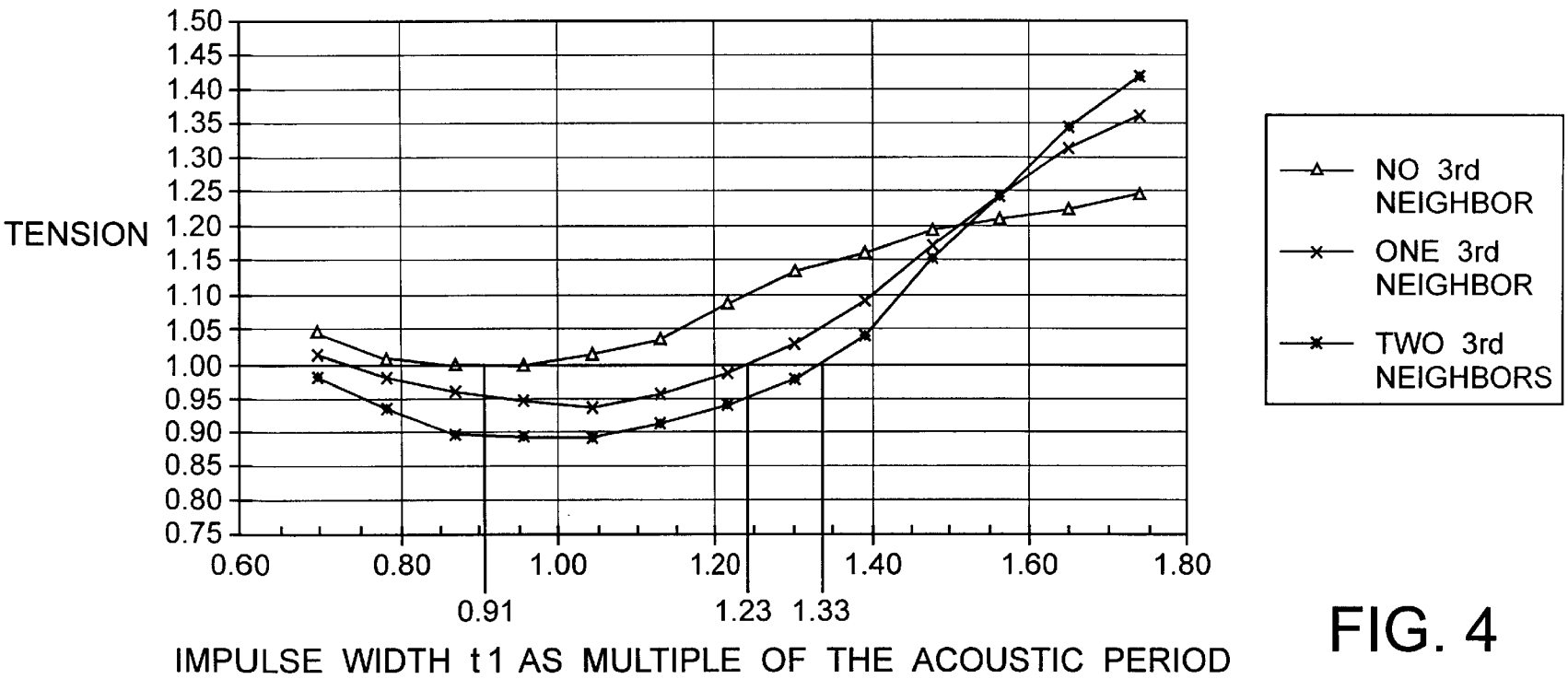
FIGS. 4 and 5 show characteristic curves of the influence of control impulse width.

Because of the connection channel 7, during activation of the one channel 3*a*, not only the immediately adjacent channels 3*b* are influenced by the originating pressure vibration, but also more remote channels. The inventors have determined that with a constant impulse form, the expulsion velocity of the droplets from an activated fourth channel 3*a* varies, depending upon whether simultaneously with this one channel 3*a*, none or one third neighboring channel 3*c* or both third neighboring channels 3*c* are activated. This difference in the droplet velocity is detrimental, because it has an unfavorable effect upon the print image. It can be avoided by means of change in the impulse form, depending upon the number of the simultaneously activated third neighboring channels For example, in FIG. 4 there is recorded the voltage for the suction impulse needed for a constant droplet velocity of v=6 m/s, as a function of the impulse duration. As can be noted from FIG. 4, the impulse form can be adjusted through change in the applied voltage and/or change in the impulse width ti in such manner, that the droplet velocity is constant, independent of the number of simultaneously activated third neighboring channels. Because of the less complicated circuitry, adjustment by means of impulse width only is preferred. As is apparent from FIG. 4, minimal suction impulse height, without any simultaneously activated third neighboring channel, is 0.91 of the acoustic period. In order to obtain with the identical impulse voltage the identical expulsion velocity with one or two simultaneously activated third neighboring channels, an impulse width of 1.23 or 1.33 of the acoustic period is required.

Figure 5:
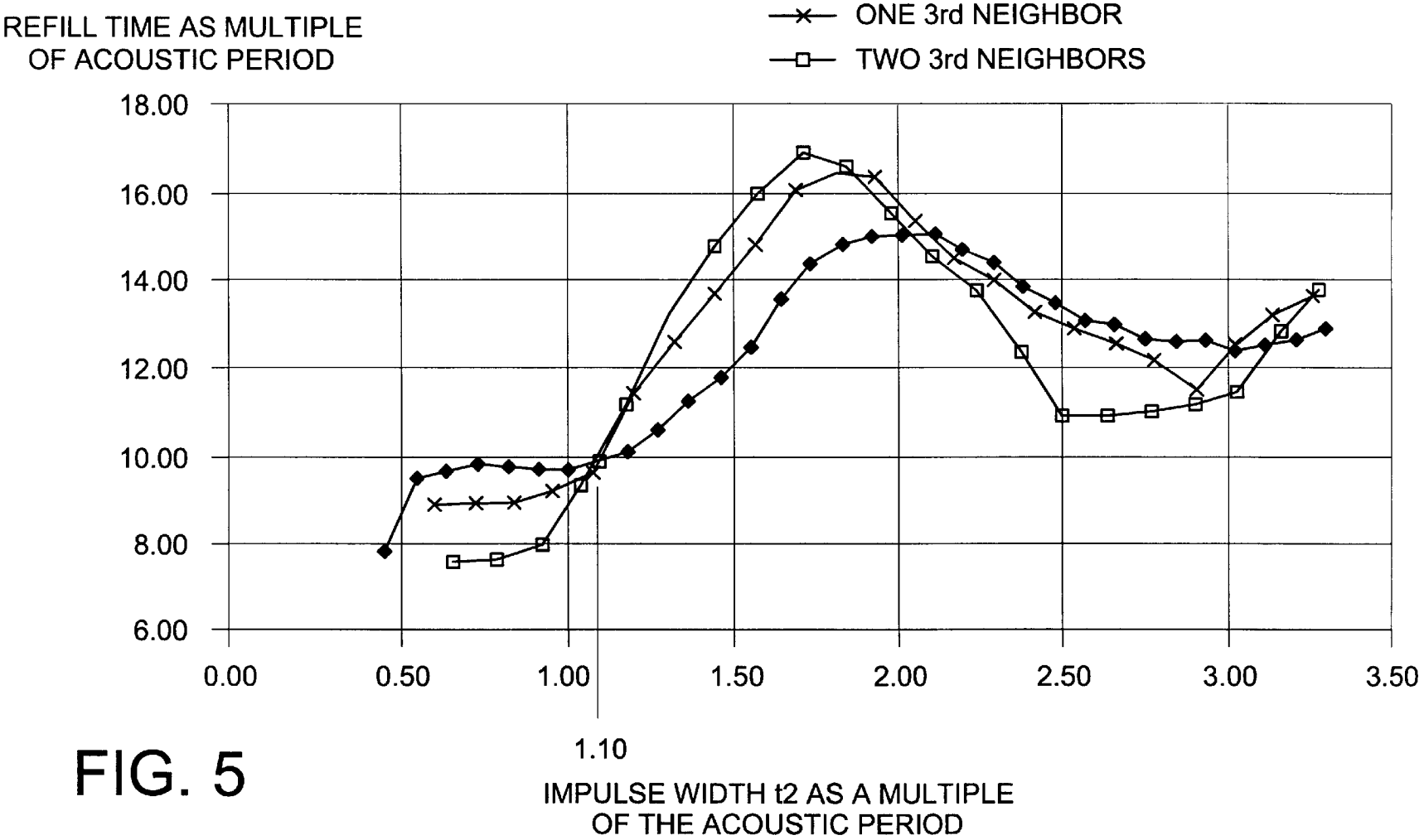

FIG. 5 depicts a similar diagram for the expulsion impulse t2, wherein there is again recorded on the time axis, the impulse width as a multiple of the acoustic period, and on the ordinate the refill time as a multiple of the acoustic period. The impulse voltage is respectively adjusted so that again a constant droplet velocity of 6 m/s is obtained. The refill time is the time interval which is required until the meniscus of the liquid at jet 6 has again attained its original position. The three variants are again recorded where simultaneously with the activated channel there is no activation of a neighboring third channel, activation of one third neighboring channel or activation of two third neighboring channels. The ascertained curves have several intersecting points. It is thus possible, during operation at one of these intersecting points to make do with only one single expulsion impulse form. Optimal in such case is the intersecting point, for which refilling time is minimal. This is the case with respect to 1.1 times the acoustic period.

Figures 6A, 6B, 6C:
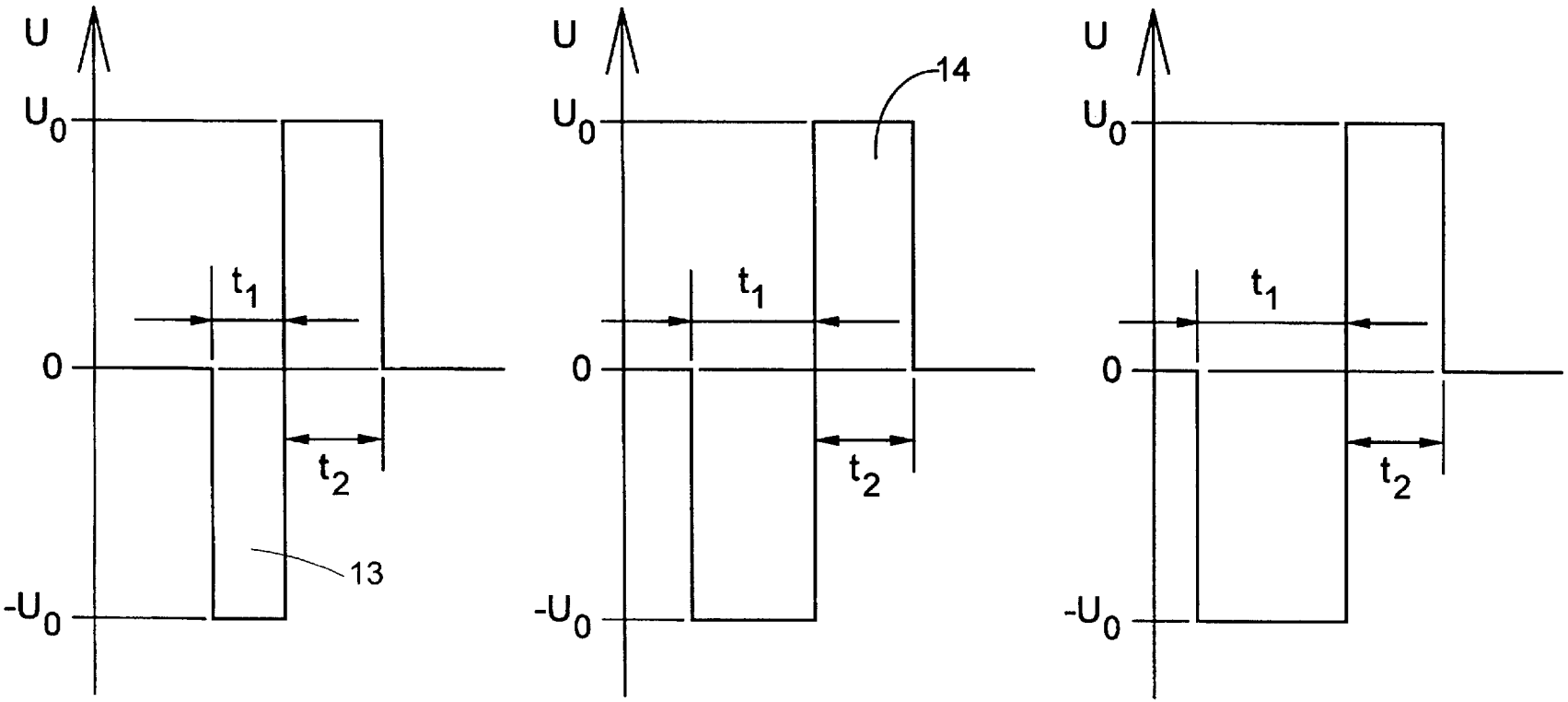
FIGS. 6*a*–6*c* shows three different impulse forms according to the present invention.

FIGS. 6*a*–6*c* show the three ascertained impulse forms for operation in absence of a simultaneously activated third neighboring channel (FIG. 6*a*), operation with one activated third neighboring channel (FIG. 6*b*) and operation with two activated third neighboring channels (FIG. 6*c*). The suction impulses have hereby varying impulse widths and the form of the expulsion impulses 14 is constant.

As is apparent from FIG. 3, the respective outermost channels 3*d* of the printhead cannot be activated, because their outer wall is rigid. If, for example, a total of 64 activatable channels are needed in the printhead, the printhead would have a total of, for example, 66 or 68 channels, whereby the respective outermost n channels are not used. A printhead with 64 activatable channels requires 65 piezo activators and 66 electrical connections. The outer wall of the most extreme channels 3*d* act like a mirror for the pressure vibration in the transverse channel 7. The occurred reflection has the same effect upon a channel operated in the vicinity as though the reflected third or sixth neighboring channel were operated simultaneously. This is appropriately taken into consideration when allocating the suction impulse width of this channel.

Figure 7:
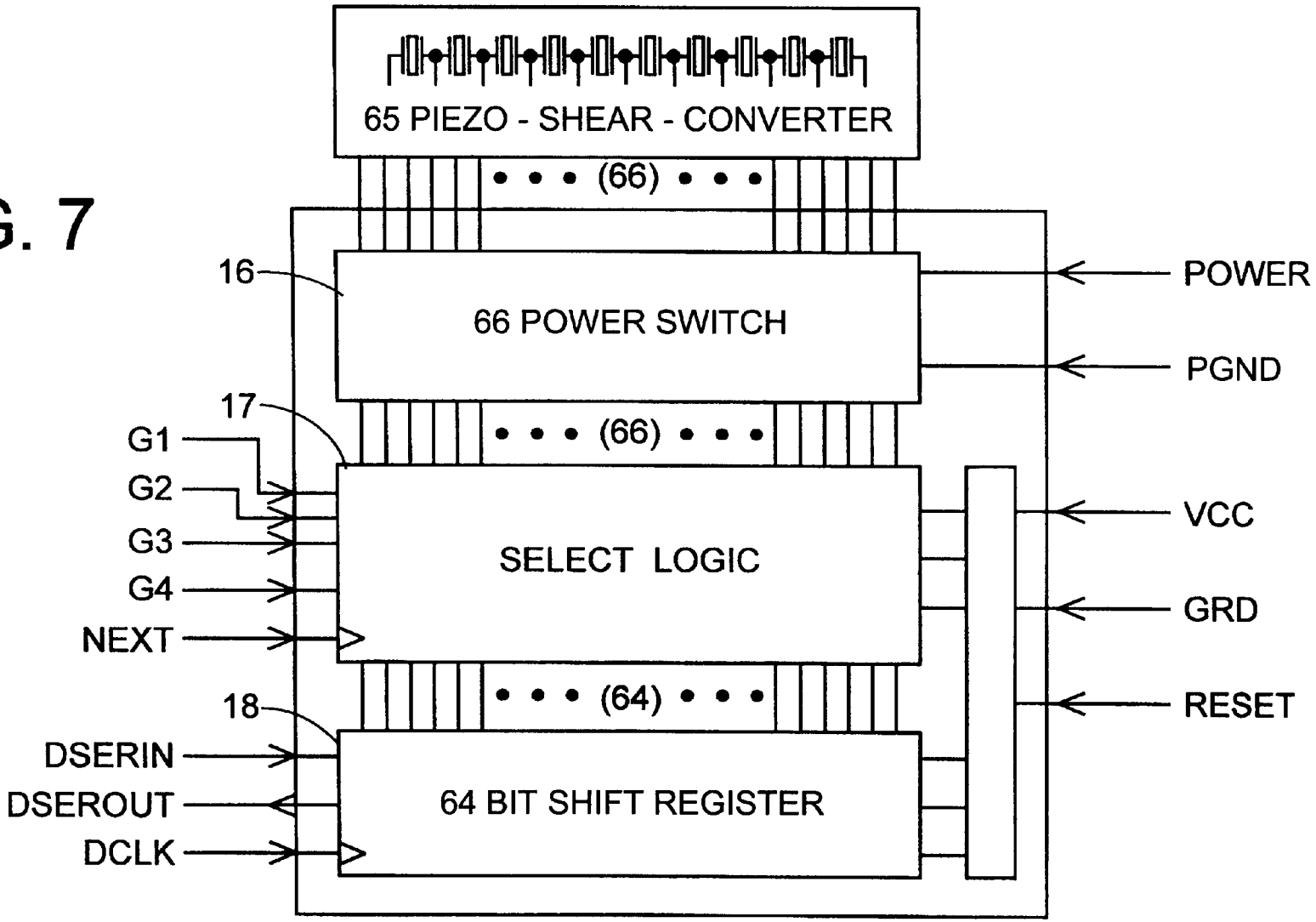
FIG. 7 shows a block diagram of an integrated selective control arrangement according to the present invention.

FIG. 1 shows a schematic view of an integrated control circuit 15, which is properly fastened on base plate 12. As a result, the number of lines which are needed for control of printhead 1 are significantly reduced. The function of the integrated control circuit is illustrated in FIG. 7. The block diagram shows the most important partial functions, consisting of power switch 16, select logic 17 and shift register 18. Only 13 lines are needed in this specific exemplary embodiment of the electrical connection to the printer control. It is of benefit, in this case, that the number of lines remains constant, even with an increase in the number of channels, and, consequently, the number of converters. Supply of voltage for the power and logic part is furnished via the connections POWER, PGND, VCC and GND. Via a RESET connection, the control is put into a defined basic state. The connections G1 to G4 and the connection NEXT are for control of the droplet generation, wherein G1 to G3 control the three different suction widths, and G4 controls the expulsion impulse width. The connections DSERIN, DSEROUT and DCLK are for transmission of data, wherein the DSROUT port is used for service purposes. The data block which has been transferred into the shift register is retransmitted to the PC or to the printer control and is compared there with the data block transmitted via DSERIN. Thus, accurate data transmission can be checked. Furthermore, the possibility exists of transmitting status information from the printhead (temperature too high, out of ink, etc.) and to evaluate the same at the PC. Via DSERIN an entire block of data (in the aforementioned example) is respectively read into the shift register for the operation of all 64 jets. The jets are operated in three stages. The information as to which jets are activated in subsequent stages, in other words, the to-be-printed pattern, is kept in the data block.

Figure 8:
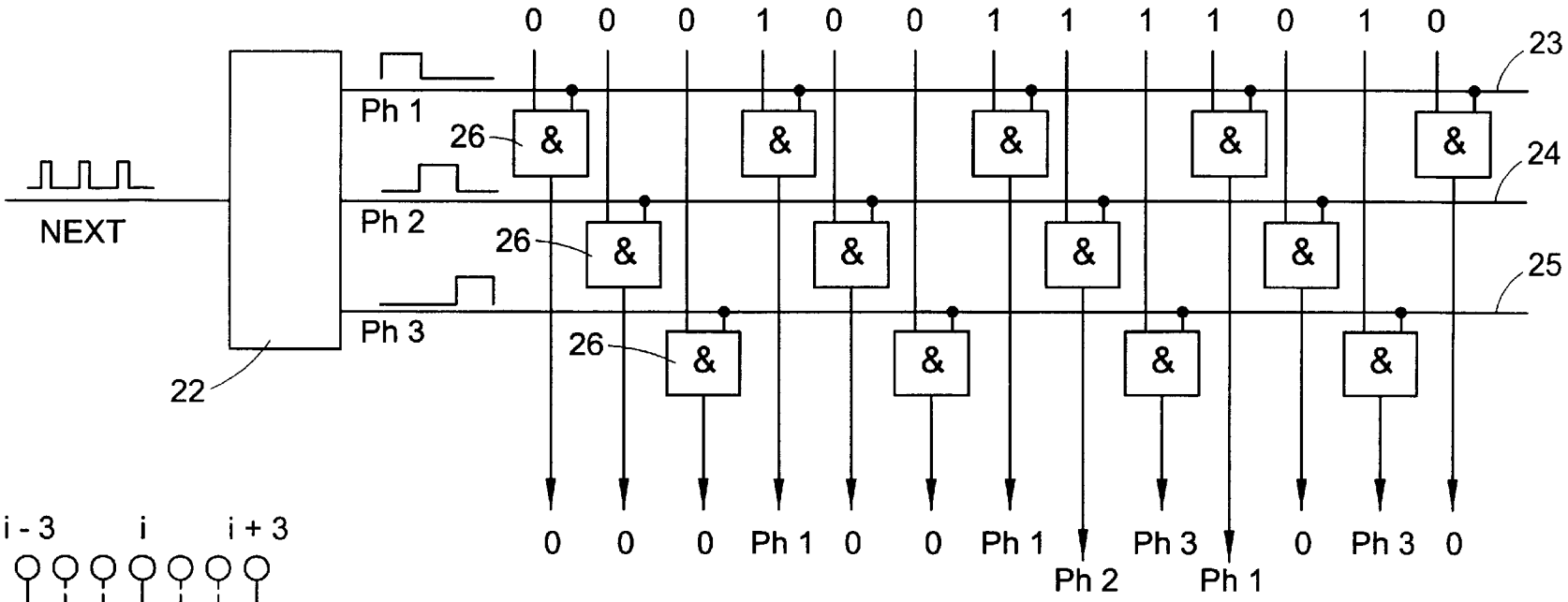
FIG. 8 shows a circuit for group selection according to the present invention.

FIG. 8 represents the first part of the select logic 17. As soon as a block of data has been read in, the NEXT signal activates the jets which belong to the first stage Ph7, provided they are selected by the contents of the shift register (in FIG. 8 the upper row of figures). Signals Ph1, Ph2 and Ph3 are successively generated with the NEXT signals via the phase switch 22. The output signals on output conductors 23, 24, 25 of the phase selection switch 22 are linked via AND-gate 26 with the input signals from the shift register 18. This ensures that in each instance no more than each third channel of the printhead is simultaneously activated. After Ph3, the NEXT signal starts again with Ph1. If, at that point in time, a new block of data has not already been read into the shift register 18 via the DSERIN input, the three phases are repeated and the jets 6 are again activated in the same pattern. Varying shades of gray can hereby be achieved. If no gradations of gray are required, then follows, after each third NEXT impulse, the reading into sliding register 18 of a new block of data, via input DSERIN, pulsed through DCKL. As soon as the new data block has been read in, the next pattern can be printed with a sequence of three NEXT impulses. Transmission of data and NEXT impulses is synchronized via the printer hardware and controlled as function of the printhead movement relative to the to-be-printed paper.

Figure 9:
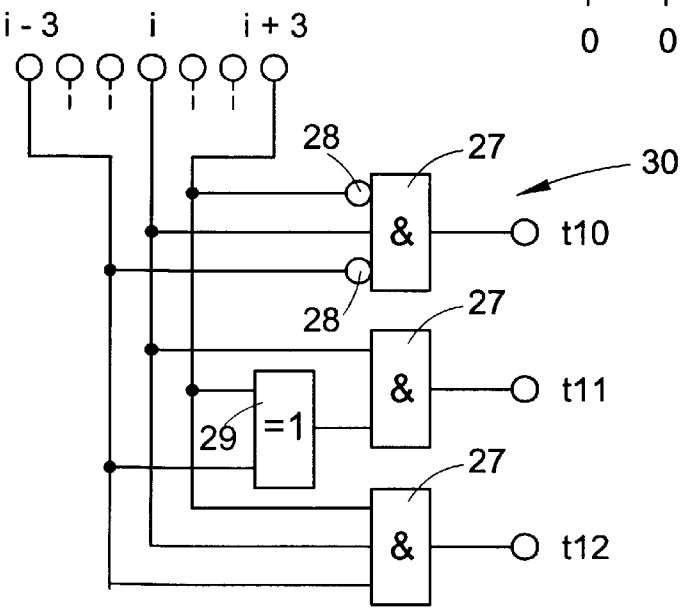
FIG. 9 shows an exemplary embodiment of a logic circuit for selection of an impulse form according to the present invention.
Figure 10:
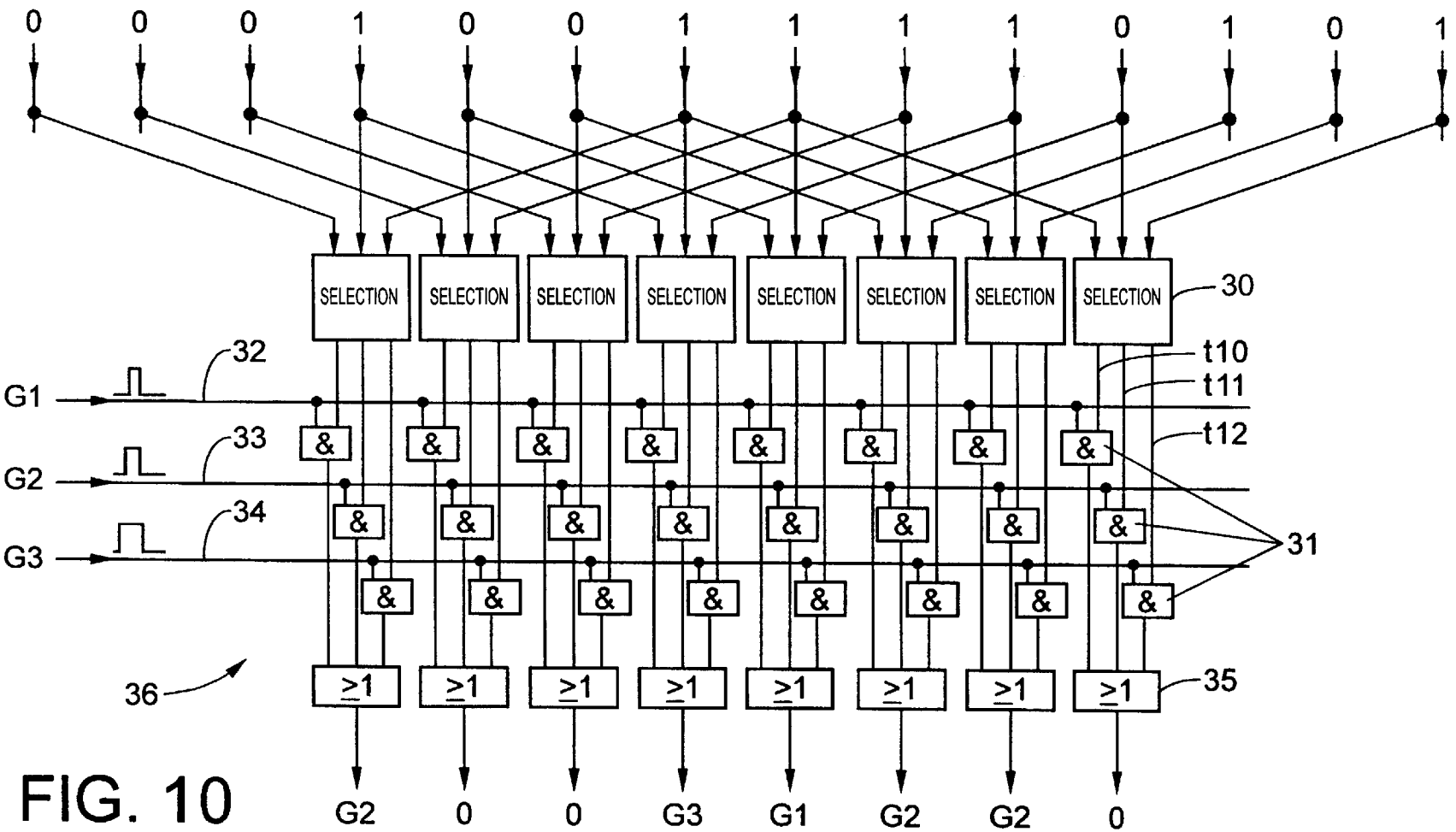
FIG. 10 shows an exemplary embodiment of a logic circuit with several channels according to the present invention.

The second part of the selection logic 17 is represented in FIG. 9. It depicts an exemplary embodiment of a circuit designed with simple logic gates, for selection of an impulse form at a given channel I, depending upon the neighboring channels. The signal for channel I is connected to one of the three inputs of each of the three AND gates 27. The signals for the two third neighboring channels I–3 and I+3 are connected to the two other inputs at the first gate 27 via an inverter 28, at the second gate 27 via an EXCLUSIVE OR and directly connected to the third gate. Depending upon whether none, one or both third neighboring channels I+1 are simultaneously activated, a signal t10, t11 or t12 appears at the first, second or third gate 27. Said selection circuit 30 is present for all activatable channels 3 of printhead 1, as represented in FIG. 10. Each of the three outputs t10, t11, t12 is connected by an AND gate 31 with the three lines 32, 33, 34, respectively, at which location appear the three signals G1, G2 and G3 for the three different suction impulses 13. The output of the three gates 31 allocated to one circuit 30 goes to the input of an OR gate 35. The impulse length at the outputs of the gates 35 is then dimensioned in such manner that the velocity of the droplets is independent from the number of simultaneously activated neighboring channels. After circuit 36, according to FIG. 10, there still follows the known "lock-on" of the expulsion impulses on the activated channels (inputs at top in FIG. 10), whereby controlling electrodes 11 then takes place via power switches 16.

The illustrated circuit is but one of the many possible exemplary embodiments, which was chosen because of its less complicated representation. Logic functions can be realized by any random combination of gates, whereby simplifications are also conceivable, where partial functions are already realized in other function blocks, for example, in order to avoid dual negations.

The solution according to the invention can still be refined if, in addition to the number of third neighboring channels, the number of the simultaneously activated sixth neighboring channels (whose effect upon exit velocity is, in fact lesser) is taken into consideration. Circuitry expense in that case is, however, higher and a total of nine different suction impulse forms are required, from which the respective form must be determined via an appropriate logic circuit.

Figure 11:
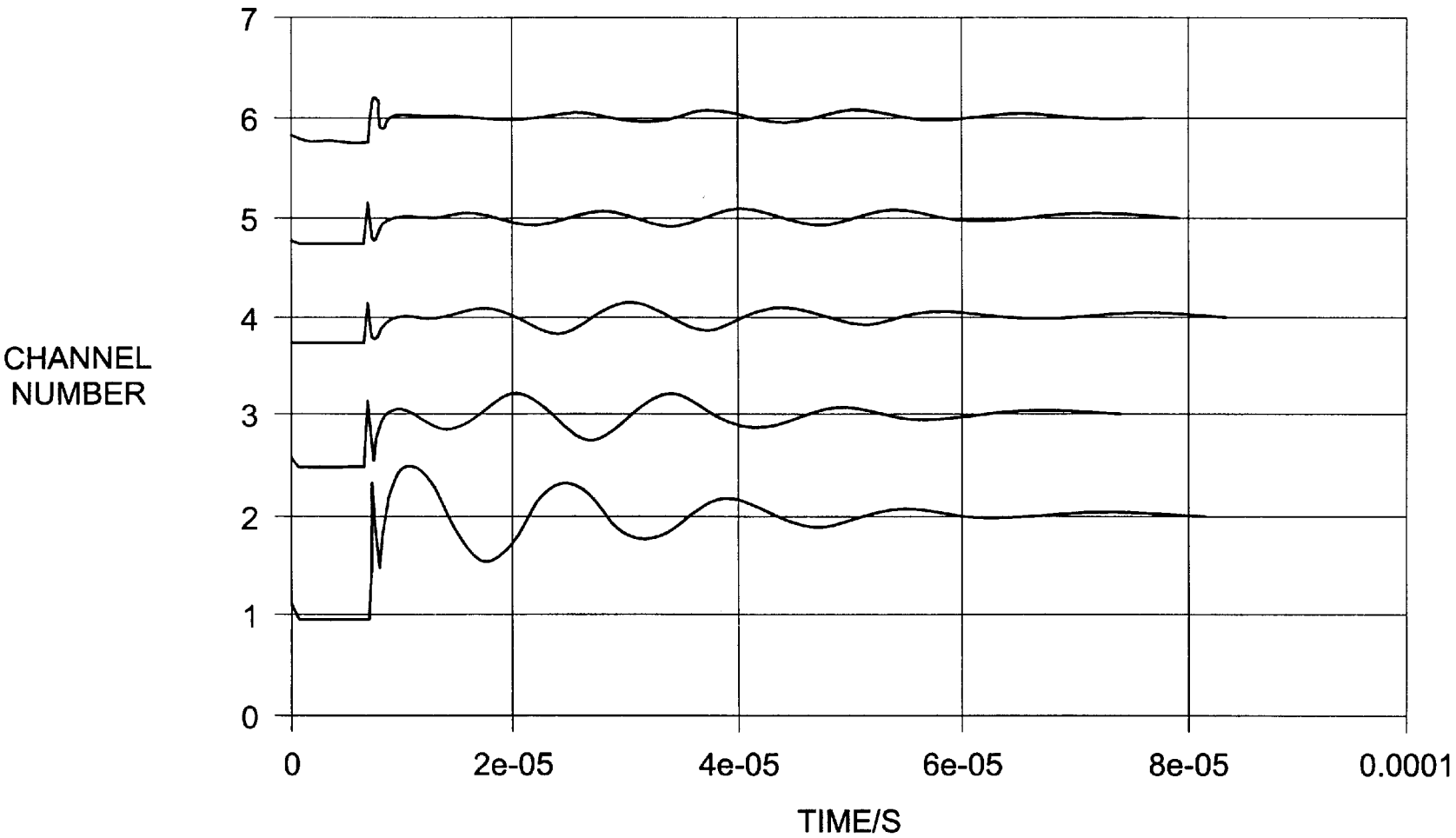
FIG. 11 shows fading of pressure waves in adjacent channels according to the present invention.

FIG. 11 shows another possibility for refinement. The illustration depicts the fading of the pressure waves in the neighboring channels when channel 0 was activated. As is apparent, the pressure vibrations in the first neighboring channel are relatively substantial and abate with increasing channel distance. If the pressure vibrations have not yet faded away in one channel before it is activated (for instance, in Phase 2 or 3 in FIG. 8), then, based on this prior history, there is a change in original conditions, which, likewise has an effect upon the droplet velocity. Specifically, with printheads for which the phases succeed each other rapidly, in other words, where there is rapid switch-over from one jet group to the next, is it appropriate to additionally take into account when selecting the impulse form, and specifically the impulse duration, how many first and second neighboring channels were operated at a fixed time interval prior to the triggering of the activated channel.

The described exemplary embodiment concerns a piezo-electrical printhead of the shear converter type. Other types of piezo-electrical printheads are also possible, for example, types with a flexural bender above each jet, for example in accordance with EP-A-713 773. With this converter type, two neighboring jets can also be simultaneously activated. The present invention can also be used with these printheads, because with these units, neighboring channels can also be influenced via pressure vibrations during activation of a jet. In such case, the linkage condition is naturally different, so that, for example, consideration can be given to the number of the simultaneously activated first and second neighboring channels.

The invention has been described with reference to a preferred embodiment thereof. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A method for controlling piezo-elements in a printhead of a droplet generator with a multitude of adjacently arranged ink channels, the method comprising:

selectively activating the channels with activation impulses; and controlling the piezo elements by modifying the activation impulses for each of the channels such that the exit velocity of ink from the each channel is independent of whether a number of nth neighboring channels are simultaneously activated.

2. The method according to claim 1 wherein modifying the activation impulse acting on the each activated channel depends upon how many nth neighboring channels are simultaneously activated.

3. The method according to claim 2 further comprising varying an impulse duration of at least one of a suction impulse and an expulsion impulse.

4. The method according to claim 2 further comprising simultaneously activating no more than each $\eta$th channel and using one of three different impulse forms depending upon whether simultaneous activation occurs in none, one or two $\eta$th neighboring channels.

5. The method according to claim 3 further comprising simultaneously activating no more than each $\eta$th channel and using one of three different impulse forms depending upon whether simultaneous activation occurs in none, one or two $\eta$th neighboring channels.

6. The method according to claim 1 further comprising varying an impulse form depending upon how many nth and 2nth neighboring channels were activated at a fixed time interval prior to triggering of actual droplet expulsion.

7. The method according to claim 1 further comprising maintaining expulsion impulses constant.

8. The method according to claim 1 further comprising selecting expulsion impulses in a manner such that refilling time of channels is minimal.

9. The method according to claim 1 wherein an end of a suction impulse of each operated channel coincides with a beginning of an expulsion impulse of each operated channel.

10. The method according to claim 1 wherein on both sides of the printhead n channels are not operated, and further comprising operating a last operated channel in such fashion as if a non-existing 2nth neighboring channel were additionally operated.

11. A method for controlling piezo-elements in a printhead of a droplet generator with a multitude of adjacently arranged ink channels, the method comprising:

selectively activating the channels with activation impulses; and controlling the piezo-elements by modifying each activation impulse acting on the each activated channel depending upon how many nth neighboring channels are simultaneously activated such that the exit velocity of ink from each channel is independent of whether a number of nth neighboring channels are simultaneously activated.

12. The method according to claim 11 further comprising varying an impulse duration of at least one of a suction impulse and an expulsion impulse.

13. The method according to claim 11 further comprising simultaneously activating no more than each nth channel and using three different impulse forms depending upon whether simultaneous activation occurs in none, one or two nth neighboring channels.

14. The method according to claim 12 further comprising simultaneously activating no more than each nth channel and using three different impulse forms depending upon whether simultaneous activation occurs in none, one or two nth neighboring channels.

15. The method according to claim 11 further comprising varying an impulse form depending upon how many nth and 2nth neighboring channels were activated at a fixed time interval prior to triggering of actual droplet expulsion.

16. The method according to claim 11 further comprising maintaining expulsion impulses constant.

17. The method according to claim 16 further comprising selecting expulsion impulses in a manner such that refilling time of channels is minimal.

18. The method according to claim 11 wherein an end of a suction impulse of each operated channel coincides with a beginning of an expulsion impulse of each operated channel.

19. The method according to claim 11 wherein on both sides of the printhead n channels are not operated, and further comprising operating a last operated channel in such fashion as if a non-existing 2nth neighboring channel were additionally operated.

* * * * *